US010344562B2

(12) United States Patent
Noske et al.

(10) Patent No.: US 10,344,562 B2
(45) Date of Patent: Jul. 9, 2019

(54) RISER ANNULAR ISOLATION DEVICE

(71) Applicant: Weatherford Technology Holdings, LLC, Houston, TX (US)

(72) Inventors: Joe Noske, Houston, TX (US); Christopher L. McDowell, New Caney, TX (US)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 241 days.

(21) Appl. No.: 15/091,418

(22) Filed: Apr. 5, 2016

(65) Prior Publication Data

US 2017/0284170 A1 Oct. 5, 2017

(51) Int. Cl.

| | |
|---|---|
| ***E21B 34/04*** | (2006.01) |
| ***E21B 17/01*** | (2006.01) |
| ***F16K 3/06*** | (2006.01) |
| ***F16K 3/16*** | (2006.01) |
| ***E21B 34/14*** | (2006.01) |
| ***E21B 33/02*** | (2006.01) |
| ***E21B 33/06*** | (2006.01) |
| ***E21B 33/064*** | (2006.01) |
| ***E21B 34/00*** | (2006.01) |

(52) U.S. Cl.

CPC ..... *E21B 34/14* (2013.01); *E21B 17/01* (2013.01); *E21B 33/02* (2013.01); *E21B 33/061* (2013.01); *E21B 33/064* (2013.01); *E21B 34/00* (2013.01); *E21B 2034/002* (2013.01)

(58) Field of Classification Search

CPC ..... F16K 3/04; F16K 3/06; F16K 3/10; F16K 3/16; F16K 3/20; F16K 3/207; E21B 33/03; E21B 33/04; E21B 33/06; E21B 34/02; E21B 34/04; E21B 17/01

USPC ..... 251/299–303, 177–179; 166/367, 368, 166/363

See application file for complete search history.

(56) References Cited

U.S. PATENT DOCUMENTS

| | | | | |
|---|---|---|---|---|
| 241,568 A * | 5/1881 | Sprat | F23L 15/02 137/250 |
| 1,414,320 A * | 4/1922 | Zuck | E21B 34/02 166/95.1 |
| 1,998,080 A * | 4/1935 | Gerlich | F16K 3/10 138/94.5 |

(Continued)

FOREIGN PATENT DOCUMENTS

| | | |
|---|---|---|
| CA | 2204297 A1 | 11/1998 |
| WO | 2015155539 A2 | 10/2015 |

OTHER PUBLICATIONS

PCT International Search Report and Written Opinion dated Sep. 4, 2017, for International Application No. PCT/US2017/025756.

(Continued)

*Primary Examiner* — Kenneth L Thompson

(74) *Attorney, Agent, or Firm* — Patterson + Sheridan, LLP

(57) ABSTRACT

In one embodiment, an annular isolation device for a riser includes a tubular body connectable to the riser. A closure member is rotatable between a closed position isolating fluid communication in the tubular body and an open position permitting fluid communication through the tubular body. The annular isolation device further includes an actuator disposed outside the tubular body and operable to rotate the closure member between the open position and the closed position.

22 Claims, 10 Drawing Sheets

OPEN POSITION
SECTION E-E

CLOSED POSITION

(56) References Cited

U.S. PATENT DOCUMENTS

| | | | | | |
|---|---|---|---|---|---|
| 2,082,940 | A * | 6/1937 | Brisbane | G05D 16/18 | 137/488 |
| 3,353,783 | A * | 11/1967 | Bolling, Jr. | F16K 3/207 | 251/172 |
| 3,602,478 | A * | 8/1971 | Cairns | F16K 31/1655 | 251/285 |
| 3,796,257 | A * | 3/1974 | Hudson | E21B 34/101 | 166/145 |
| 4,499,919 | A | 2/1985 | Forester | | |
| 4,890,674 | A * | 1/1990 | Le | E21B 34/105 | 166/319 |
| 5,167,283 | A | 12/1992 | Smith et al. | | |
| 5,706,893 | A * | 1/1998 | Morgan | E21B 33/043 | 166/75.14 |
| 6,464,203 | B1 * | 10/2002 | Ishigaki | F16K 3/10 | 251/215 |
| 7,195,225 | B1 | 3/2007 | Holliday | | |
| 7,731,151 | B2 | 6/2010 | Lee | | |
| 7,963,339 | B2 | 6/2011 | Cowie et al. | | |
| 8,191,570 | B2 * | 6/2012 | Purkis | E21B 34/12 | 137/493.9 |
| 8,403,293 | B2 | 3/2013 | Cowie et al. | | |
| 9,249,647 | B2 * | 2/2016 | Kobe | E21B 33/04 | |
| 9,850,740 | B2 * | 12/2017 | Atencio | E21B 34/02 | |
| 2010/0051847 | A1 | 3/2010 | Mailand et al. | | |

OTHER PUBLICATIONS

International Preliminary Report on Patentability in related application PCT/US2017/025756 dated Oct. 9, 2018.

* cited by examiner

OPEN POSITION
SECTION E-E

CLOSED POSITION

RISER ANNULAR ISOLATION DEVICE

BACKGROUND OF THE INVENTION

Field of the Invention

Embodiments of the invention generally relate to methods and apparatus for controlling fluid flow in a riser.

Description of the Related Art

In wellbore construction and completion operations, a wellbore is formed to access hydrocarbon-bearing formations (e.g., crude oil and/or natural gas) by the use of drilling. Drilling is accomplished by utilizing a drill bit that is mounted on the end of a drill string. To drill within the wellbore to a predetermined depth, the drill string is often rotated by a top drive or rotary table on a surface platform or rig, and/or by a downhole motor mounted towards the lower end of the drill string. After drilling to a predetermined depth, the drill string and drill bit are removed and a section of casing is lowered into the wellbore. An annulus is thus formed between the string of casing and the formation. The casing string is temporarily hung from the surface of the well. A cementing operation is then conducted in order to fill the annulus with cement. The casing string is cemented into the wellbore by circulating cement into the annulus defined between the outer wall of the casing and the borehole. The combination of cement and casing strengthens the wellbore and facilitates the isolation of certain areas of the formation behind the casing for the production of hydrocarbons.

Deep water offshore drilling operations are typically carried out by a mobile offshore drilling unit (MODU), such as a drill ship or a semi-submersible, having the drilling rig aboard and often make use of a marine riser extending between the wellhead of the well that is being drilled in a subsea formation and the MODU. The marine riser is a tubular string made up of a plurality of tubular sections that are connected in end-to-end relationship. The riser allows return of the drilling mud with drill cuttings from the hole that is being drilled. Also, the marine riser is adapted for being used as a guide for lowering equipment (such as a drill string carrying a drill bit) into the hole.

There is a need, therefore, for an annular isolation device that is able to selectively control fluid communication in a wellbore of the riser string.

SUMMARY OF THE INVENTION in one embodiment, an annular isolation device for a riser includes a tubular body connectable to the riser. A closure member is rotatable between an open position permitting fluid communication through the tubular body and a closed position isolating fluid communication. An actuator is disposed outside the tubular body and operable to rotate the closure member between the open position and the closed position.

The closure member is rotatable about an axis intersecting a centerline of a bore of the tubular body. The axis of rotation is perpendicular to the centerline of the bore of the tubular body. The closure member has a bore therethrough and the bore of the closure member is aligned with the bore of the tubular body when the closure member is in the open position. The bore of the closure member is the same or greater than the bore of the tubular body.

The annular isolation device further includes an actuator including a piston disposed on a shaft. In some embodiments, the actuator further includes a tab and the closure member includes: a shell including a hemispherical face and a hinge including a groove for receiving the tab of the actuator. The closure member is coupled to the actuator by the groove and the tab.

In some embodiments, the actuator further includes a geared shaft portion and the closure member includes: a cylinder and an outer surface having geared teeth configured to engage the geared shaft portion. The closure member is coupled to the actuator by the geared shaft portion and the geared teeth of the closure member.

In some embodiments, the shaft further includes a spline and the closure member includes: a disc, a hinge for rotating the closure member, and a keyway for receiving the spline. The spline is disposed in the keyway and operable to move the closure member between the closed position and the open position.

The annular isolation device further includes a closure housing, wherein the closure member is disposed in the closure housing when the closure member is in the open position. The closure housing is at least partially disposed outside the tubular body. The diameter of the closure housing is greater than a diameter of the tubular body.

The annular isolation device further includes an outer housing, wherein the actuator is at least partially disposed in the outer housing. The actuator is at least partially disposed in the closure housing. The actuator includes a piston disposed on a shaft. The actuator further includes a tab. The closure member further includes a shell having a hemispherical face and a hinge including a groove for receiving the tab of the actuator. The closure member is coupled to the actuator by the groove and the tab.

In some embodiments, the annular isolation device further includes a first sleeve member disposed in the tubular body. The first sleeve member is configured to axially move the closure member into an engaged position. The annular isolation device also includes a second sleeve member configured to contact the closure member in the engaged position. The first sleeve member is axially movable to contact the closure member.

In some embodiments, the first sleeve member is axially movable between a first position and a second position. In the first position, the first sleeve member isolates the tubular body from the closure housing. In the second position, the closure housing is open to the tubular body.

Alternatively, the actuator may include a geared shaft portion. The closure member may include a cylinder having a bore therethrough and an outer surface having geared teeth configured to engage the geared shaft portion. The closure member is coupled to the actuator by the geared shaft portion and the geared teeth of the closure member. The bore of the cylinder is perpendicular to the rotational axis of the cylinder. The bore of the cylinder is aligned with the bore of the tubular body when the closure member is in the open position.

In another embodiment, an annular isolation device for a riser includes a tubular body connectable to the riser. A first sleeve member is disposed in the tubular body. A second sleeve member is disposed in the first sleeve member. The first sleeve member is axially movable relative to the second sleeve member. A closure member is movable with the first sleeve member and is movable between an open position permitting fluid communication through the tubular body and a closed position isolating fluid communication.

The second sleeve member moves the closure member to the open position. The second sleeve member maintains the closure member in the open position. The closure member is disposed in a recess formed between the second sleeve member and the tubular body in the open position. The annular isolation device for a riser further includes a biasing member operable to bias the closure member to the closed position, wherein the closure member contacts the first sleeve member. A third sleeve member is disposed in the tubular body and configured to engage the closure member in an engaged position. The closure member is movable to the engaged position using the first sleeve member.

A method for controlling fluid flow in a riser includes rotating a closure member between a closed position isolating fluid communication through a tubular body and an open position permitting fluid communication through the tubular body using an actuator disposed outside of the tubular body.

A method for controlling fluid flow in a riser includes: moving a closure member with a first sleeve member; moving the closure member between a closed position isolating fluid communication through a tubular body and an open position permitting fluid communication through the tubular body; and maintaining the closure member in the open position using a second sleeve member. The method also includes moving the closure member to an engaged position, where a third sleeve member contacts the closure member. In the engaged position, the first sleeve member provides additional force to the closure member.

In another embodiment, an annular isolation device for a riser includes a tubular body connectable to the riser. A closure member is movable between a closed position isolating fluid communication in the tubular body and an open position permitting fluid communication through the tubular body. The annular isolation device further includes a closure housing, wherein the closure member is disposed in the closure housing when in the open position. A sleeve member is disposed in the tubular body and configured to axially move the closure member into the closed position. A seat member is configured to contact the closure member in the closed position.

Furthermore, an actuator is coupled to the closure member, wherein the actuator is operable to move the closure member between the open position and the closed position, wherein the closure member is disposed in the tubular body. The closure member is rotatable by the actuator. The actuator may include a piston coupled to a shaft and wherein the shaft further includes a spline. The closure member may include a disc, a hinge for rotating the closure member, and a keyway for receiving the spline. The spline is disposed in the keyway and operable to move the closure member between the closed position and the open position.

Further, the closure housing is disposed on an outer surface of the tubular body. The sleeve member is axially movable to a closed position isolating the tubular body from the closure housing. The sleeve member is axially movable to an open position, opening the closure housing to the tubular body.

An outer housing is disposed on an outer surface of the tubular body. The actuator is disposed in the outer housing. The sleeve member is axially movable to engage the closure member.

A method of controlling fluid flow in a riser includes: rotating a closure member from a closure housing to a bore of a tubular body connected to the riser, thereby isolating fluid flow in the tubular body. The method also includes: moving the closure member using a sleeve member disposed in the tubular body, engaging the closure member with a seat member disposed in the tubular body, moving the sleeve member axially to isolate the bore of the tubular body from the closure housing, and moving a shaft longitudinally through a keyway of the closure member to rotate the closure member.

In another embodiment, an annular isolation device for a riser includes a tubular body connectable to the riser. A closure member is movable between an open position permitting fluid communication through the tubular body and a closed position isolating fluid communication. The closure member is angled relative to a bore of the tubular body when in the closed position. The annular isolation device further includes a first sleeve member operable to move the closure member to the closed position. The closure member is biased to the open position. A second sleeve member is configured to contact the closure member in the closed position. A face of the second sleeve member configured to contact the closure member is angled relative to the bore of the tubular body.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1A:
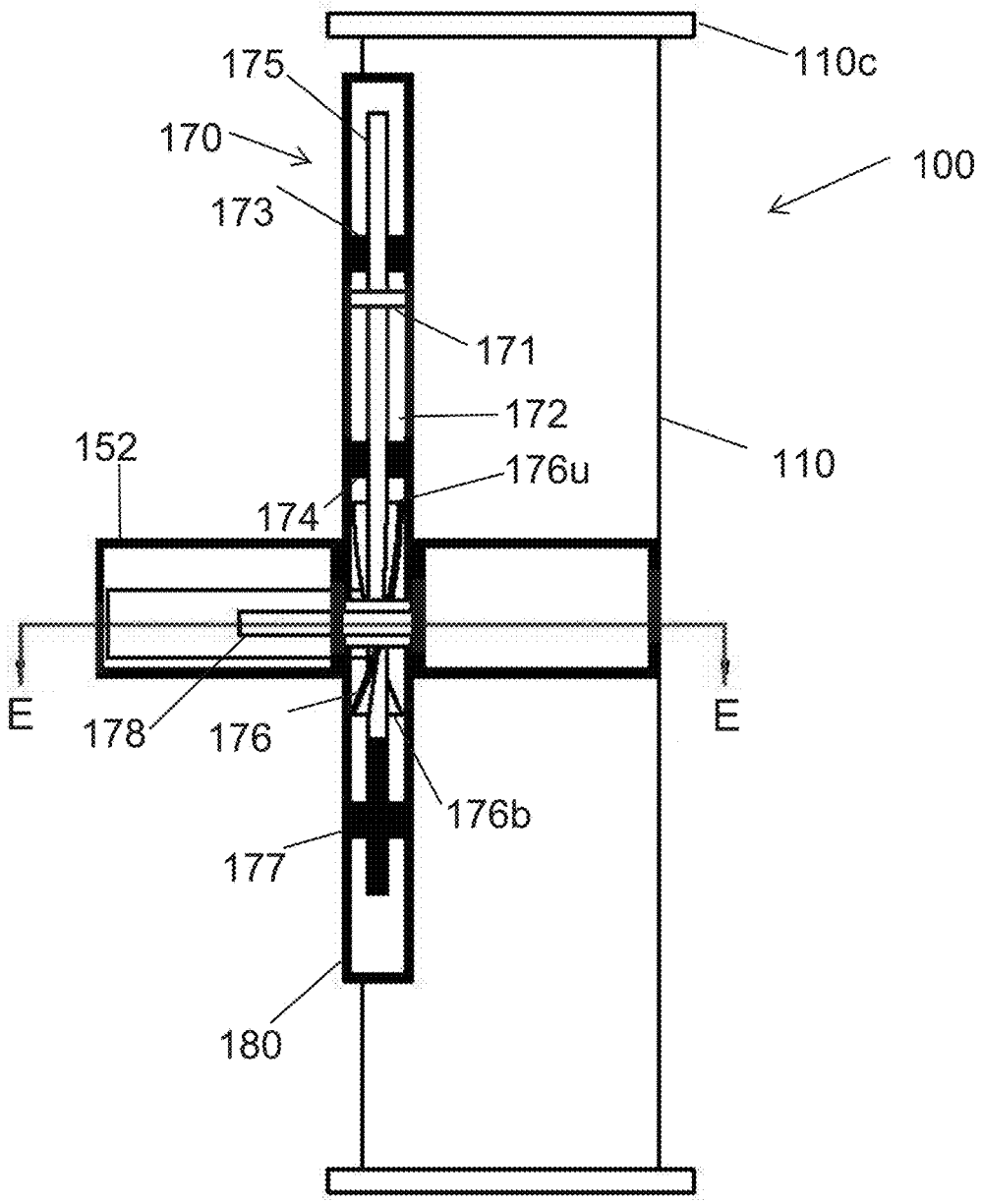
FIG. 1A illustrates an annular isolation device for a riser, according to one embodiment of the present invention.

FIGS. 1A-E illustrate an annular isolation device 100 for a riser, according to one embodiment of the present invention. The annular isolation device 100 may include a tubular body 110, a sleeve member 140 (FIG. 1D), a closure member, such as a disc 151 (FIG. 1E), a seat member 160 (FIG. 1D), and an actuator assembly 170.

The tubular body 110 may have a bore 110*b* (FIG. 1B) extending longitudinally therethrough. The tubular body 110 may be a section of a tubular string. The tubular body 110 may have couplings 110*c* at longitudinal ends for connecting to another section of the tubular string. Couplings 110*c* may be flanged couplings. The tubular body 110 may be a marine drilling riser.

An outer housing 180 may be disposed on the outer surface of the tubular body 110. The outer housing 180 may be located outside of the tubular body 110. The outer housing 180 may have a cylindrical shape. The outer housing 180 may extend longitudinally along the outer surface of the tubular body 110. The actuator assembly 170 may be disposed in the outer housing 180. The actuator assembly 170 may include a piston 171, a hydraulic chamber 172, seals 173, 174, a shaft 175, and at least one spline 176 (two shown). The hydraulic chamber 172 may be formed between seals 173, 174. The hydraulic chamber 172 may be filled with a hydraulic fluid. Seals 173, 174 may prevent leakage of hydraulic fluid from the hydraulic chamber 172. Seals 173, 174 may be elastomeric seals.

The piston 171 may be a disc formed on the shaft 175 and disposed in the hydraulic chamber 172. The piston 171 may seal against the inner surface of the outer housing 180. The piston 171 may separate the hydraulic chamber 172 into a first side and a second side. The hydraulic chamber 172 may have a first port and a second port formed through an outer wall of the outer housing 180, each port in fluid communication with a respective side of the hydraulic chamber 172. The shaft 175 may run through seals 173, 174. At least one spline 176 (two shown) may be formed on the shaft 175. The spline 176 may have an upper portion 176*u* and a lower portion 176*b*. The upper portion 176*u* of the spline 176 may be substantially straight. The lower portion 176*b* of the spline 176 may curve along and around the longitudinal axis of the shaft 175, such as a helical curve. The shaft 175 may extend through a bearing 177 at an end opposite the hydraulic chamber 172 of the outer housing 180. The shaft 175 may be rotationally fixed relative to the outer housing 180, such as by a spline (not shown) engaging a groove (not shown) of the outer housing 180.

Figure 1B:
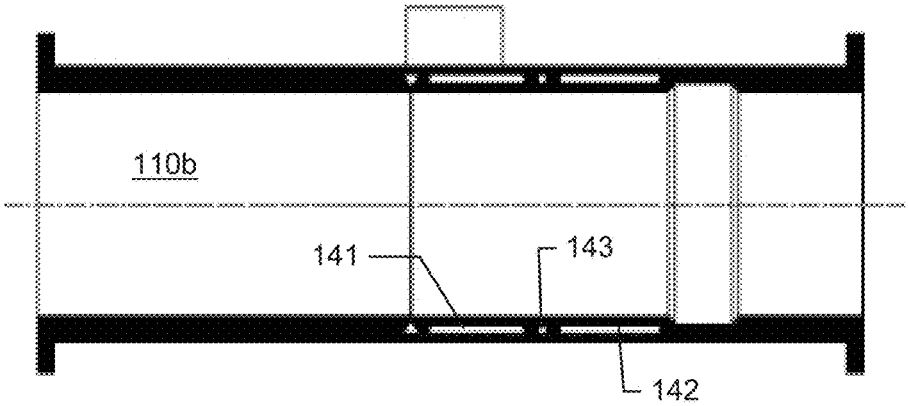
FIG. 1B-D illustrate a longitudinal cross-section of an annular isolation device for a riser, according to one embodiment of the present invention.
Figure 1C:
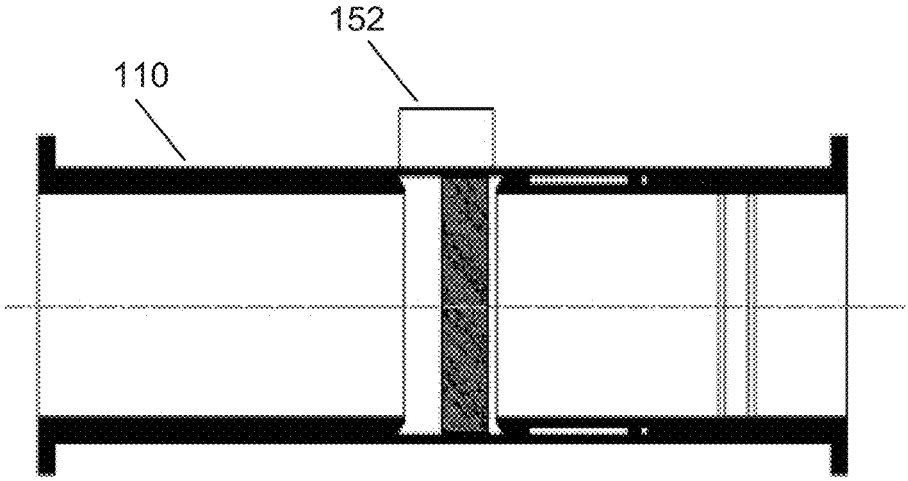
Figure 1D:
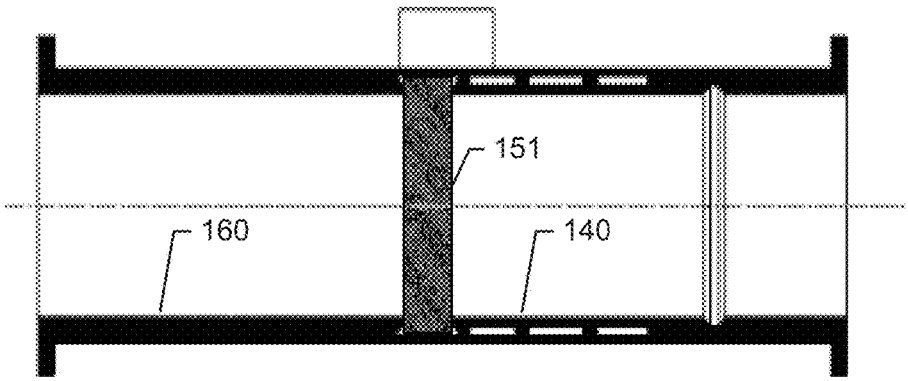
Figure 1E:
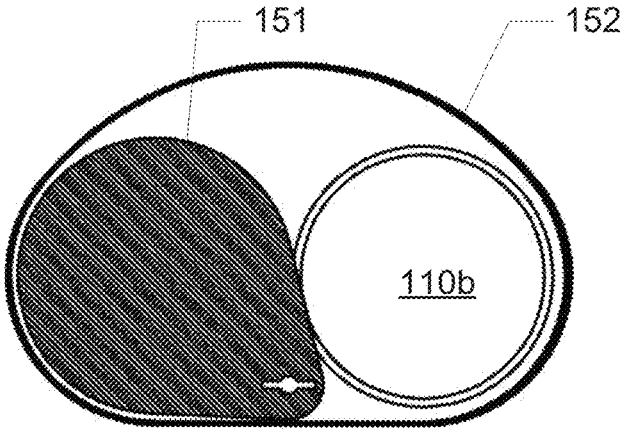
FIG. 1E illustrates a radial cross-section of an annular isolation device for a riser, according to one embodiment of the present invention.
Figure 1E:
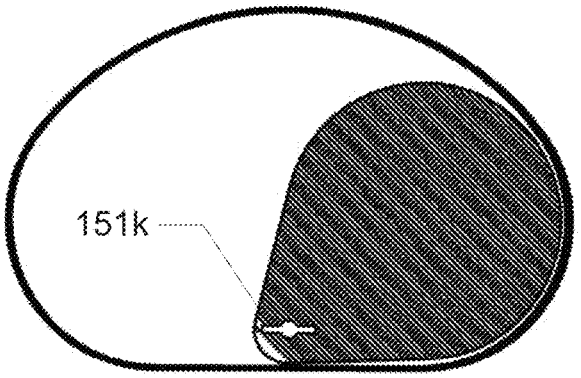

Referring to FIGS. 1A and 1E, a closure housing 152 may be disposed on the outside of the tubular body 110. The closure housing 152 may be adjacent to the outer housing 180. The closure housing 152 may be open to the outer housing 180. The closure housing 152 may be open to the tubular body 110 when the sleeve member 140 is in an open position, described below. A hinge 178 may be disposed in the closure housing 152. The hinge 178 may extend into the outer housing 180. The hinge 178 may be pivotally coupled to the outer housing 180. The hinge 178 may be rotationally fixed to a closure member, such as the disc 151 (FIG. 1D). The disc 151 may have a keyway 151*k* (FIG. 1E) formed therethrough for receiving the spline 176. The keyway 151*k* allows for axial movement of the spline 176 and the shaft 175 in the outer housing 180. The hinge 178 may rotate with the disc 151. The closure housing 152 may retain the disc 151 when the sleeve member 140 is in a closed position, as discussed below.

Referring to FIGS. 1B-D, the sleeve member 140 may be disposed in the tubular body 110. The sleeve member 140 may isolate the bore 110*b* of the tubular body 110 from the outer housing 152 when in a first position (FIG. 1B). The sleeve member 140 may have a shoulder for engaging an upper face of the disc 151. A first hydraulic chamber 141 and a second hydraulic chamber 142 may be formed between an outer surface of the sleeve member 140 and an inner surface of the tubular body 110. The first hydraulic chamber 141 and second hydraulic chamber 142 may be separated by an annular piston 143. The annular piston 143 may be longitudinally coupled to the sleeve member 140. Ports may be formed in the outer surface of the tubular body 110, the ports in fluid communication with hydraulic chambers 141 and 142. Fluid pressure in the chamber may act on the piston 143, thereby moving the sleeve member 140 relative to the tubular body 110. The seat member 160 may be disposed in the tubular body 110. The seat member 160 may be fixed axially, relative to the tubular body 110. The seat member 160 may be an inner sleeve. The seat member 160 may have a shoulder for engaging a lower face of the disc 151.

The process to isolate fluid communication in the tubular body 110 will now be described. FIG. 1B shows the tubular body 110 in a position permitting fluid communication through the bore 110*b*. Initially, the sleeve member 140 is in the first position, isolating the bore 110*b* from the outer housing 152. Hydraulic fluid is supplied to the hydraulic chamber 141 to longitudinally move the annular piston 143 relative to the tubular body 110. In turn, the annular piston 143 moves the sleeve member 140 longitudinally from the first position (FIG. 1B) to the open or second position (FIG. 1C). When the sleeve member 140 is in the second position, the closure housing 152 is open to the bore 110*b*.

Hydraulic fluid is then supplied to the hydraulic chamber 172 to longitudinally move the piston 171 towards seal 174, thereby moving the shaft 175 and spline 176 longitudinally towards the bearing 177. As the spline 176 moves through the keyway 151*k* of the disc 151, an inner surface of the keyway 151*k* contacts the curve of the lower portion 176*b* of the spline 176. Because the shaft 175 is rotationally fixed relative to the outer housing 180, the curve of the lower portion 176*b* forces the hinge 178 and the disc 151 to rotate. As the lower portion 176*b* moves through the keyway 151*k*, the disc 151 rotates from a first or open position where the disc 151 is disposed in the closure housing 152 to a second or closed position where the disc 151 is disposed in the bore 110*b* of the tubular body 110, between the sleeve member 140 and the seat member 160 and isolating fluid communication in the tubular body 110. The hinge 178 and the disc 151 are rotated until the upper portion 176*u* of the spline 176 enters the keyway 151*k* of the disc 151. The piston 171 continues moving longitudinally towards the bearing 177 until the upper portion 176*u* of the spline has moved substantially through the keyway 151*k*.

Hydraulic fluid is then supplied to the hydraulic chamber 142 to longitudinally move the annular piston 143 toward the disc 151. The annular piston 143 moves the sleeve member 140 axially from the first position (FIG. 1C) to a third position where the shoulder of the sleeve member 140 engages the upper face of the disc 151. The sleeve member 140 then moves the disc 151 axially to an engaged position where the disc 151 engages the shoulder of the seat member 160 (FIG. 1D). The disc 151 does not rotate as the sleeve member 140 axially moves the disc 151 because the straight upper portion 176*u* of the spline 176 passes back through the keyway 151*k*. The pressure in the hydraulic chamber 142 acting on the annular piston 143 provides an additional sealing force between the disc 151 and the sleeve member 140 and between the disc 151 and the seat member 160. Alternatively, the actuator assembly 170 may be a motor for controlling the movement of the sleeve member 140 and disc 151.

The steps of the process to isolate the bore 110*b* may be reversed to open the bore 110*b* and permit fluid communication through the housing 110. Hydraulic fluid is supplied to the hydraulic chamber 141 to disengage the sleeve member 140 from the disc 151. The sleeve member 140 moves longitudinally in the tubular body 110, opening the closure housing 152 to the bore 110*b* of the tubular body 110. Hydraulic fluid is then supplied to the hydraulic chamber 172 to move the piston 171 towards the seal 173. As the lower portion 176*b* of the spline 176 moves through the keyway 151*k*, the force acting between the lower portion 176*b* and the keyway 151*k* causes the disc 151 and the hinge 178 to rotate. The piston 171 continues moving towards the seal 174 until the disc 151 has been rotated completely into the closure housing 152. Hydraulic fluid is then supplied to the hydraulic chamber 142 to move the sleeve member 140 and isolate the closure housing 152 from the bore 110*b* of the tubular body 110.

Alternatively, the closure member may be a wedge with tapered faces. The wedge may be disposed in the closure housing 152 when in the open position, as described above. The actuator may rotate the wedge from the open position to a closed position, as described above using the piston 171 and shaft 175. The actuator may rotate the wedge out of a closure housing and into a bore of the tubular body. The wedge may be disposed in the bore of the tubular body in the closed position. The tapered faces may engage a respective tapered face on each of the sleeve member and the seat member. The sleeve member and the seat member may be fixed axially in the tubular body. The contact between the tapered faces of the wedge, the sleeve member, and the seat member may create a seal, isolating fluid communication through the tubular body in the closed position. Alternatively, the tapered faces of the wedge may seal against a tapered face of the tubular body. The process may be reversed to move the wedge from the closed position to the open position. The actuator may move the wedge from the bore of the tubular mandrel to the closure housing. The wedge may move out of engagement with the seat member and the sleeve member, permitting fluid communication through the tubular body. The wedge may be disposed in the closure housing in the open position. In another embodiment, the wedge may be movable longitudinally out of the closure housing. The actuator may be a piston coupled to the wedge. The piston may be disposed in the closure housing. The wedge may be movable by the piston. The piston may push the closure member out of the closure housing into the closed position. The piston may push the closure member into a bore of the tubular body. The piston may force the tapered faces of the wedge into engagement with the respective tapered faces of the sleeve member and the seat member, isolating fluid communication through the tubular body. The process may be reversed to move the wedge from the closed position to the open position. The piston may retract and move the closure member out of the bore of the tubular body. The piston may continue pulling the closure member into the closure housing.

Alternatively, a port may be disposed in a wall of the tubular body 110 below the closure member. The port may be operated to relieve pressure buildup in the tubular body under the closure member. When the port is in an open position, the port may be in fluid communication with the bore of the tubular body below the closure member. The port may be connected by a fluid line to the MODU. Alternatively, the port may be disposed in a wall of the closure housing below the closure member.

Alternatively, a plurality of pressure transducers may be used to measure a pressure in the bore of the tubular body above and below the closure member. The pressure transducers may be located in a wall of the tubular body. The measured pressure in the bore of the tubular body may be used to determine when to relieve pressure in the tubular body under the closure member by using the port.

FIG. 2A-E illustrates an alternative embodiment of the present invention. The annular isolation device 200 may include a tubular body 201, an outer housing 210, a closure housing 215, a closure member 220, and an actuator, such as piston 230. The tubular body 201 may be a section of a tubular string. The tubular body 201 may have a longitudinal bore 201*b* therethrough. The tubular body 201 may have couplings 201*c* at longitudinal ends for connecting to another section of the tubular string. Couplings 201*c* may be flanged couplings. The tubular body 201 may be a marine drilling riser.

The outer housing 210 may be disposed on an outer surface of the tubular body 201. The outer housing 210 may be located outside of the tubular body 201. The outer housing 210 may have a cylindrical shape. The outer housing 210 may extend longitudinally along the outer surface of the tubular body 201. The closure housing 215 may be at least partially disposed in the tubular body 201. The closure housing 215 may be at least partially disposed outside of the tubular body 201. The closure housing 215 may have a diameter greater than the tubular body 201. The outer housing 210 may be disposed on an outer surface of the closure housing 215.

The actuator may be at least partially disposed in the outer housing 210. The actuator may be at least partially disposed in the closure housing 215. The actuator may be disposed outside of the tubular body 201. The actuator may be a piston 230 and a shaft 231. The piston 230 may be disposed in the outer housing 210. The piston 230 may be disposed in a piston chamber 230*p* formed between seals 232, 234. Seals 232, 234 may prevent leakage of fluid from the piston chamber 230*p*. The piston 230 may be a disc disposed on the shaft 231. The shaft 231 may be at least partially disposed in the outer housing 210. The shaft 231 may be at least partially disposed in the closure housing 215. The shaft 231 may be axially movable in the outer housing 210 and the closure housing 215. The shaft 231 may run through seals 232, 234. The shaft 231 may extend through bearing 235 located at an end of the outer housing 210 opposite the piston chamber 230*p*. A tab 233 may be formed on an outer surface of the shaft 231. The tab 233 may be formed on a portion of the shaft 231 disposed in the closure housing 215. The tab 233 may extend perpendicularly to a longitudinal axis of the shaft 231.

Figure 2B:
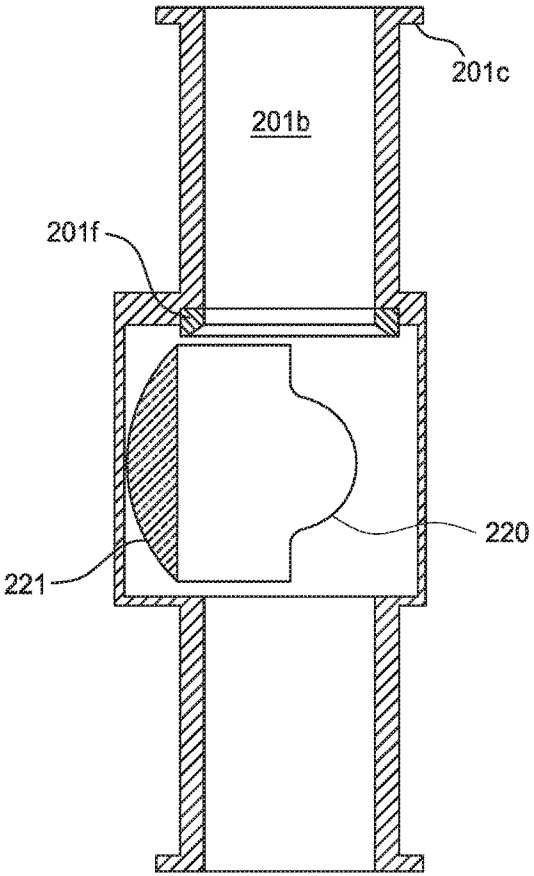
FIGS. 2B and 2D illustrate a longitudinal cross-section of an annular isolation device for a riser, according to an alternative embodiment of the present invention.
Figure 2A:
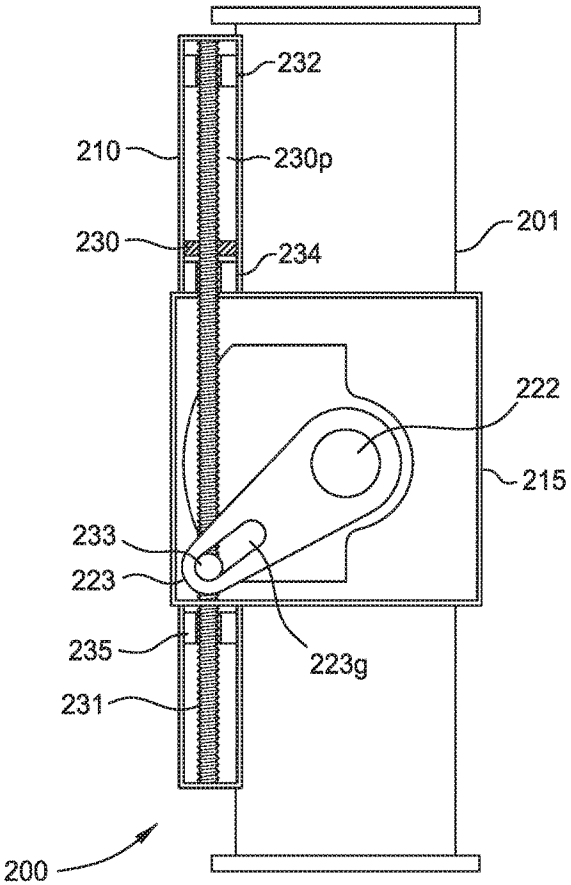
FIGS. 2A and 2C illustrate an annular isolation device for a riser, according to an alternative embodiment of the present invention.
Figure 2D:
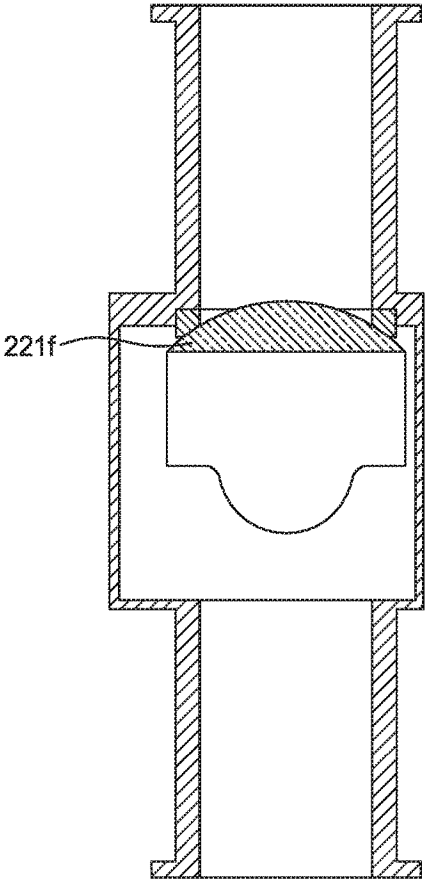
Figure 2C:
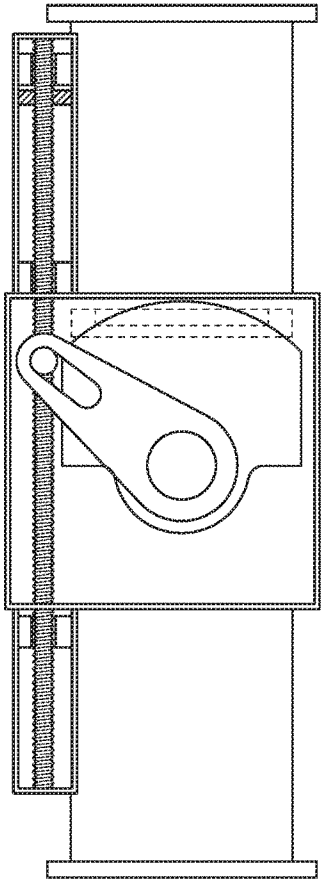
Figure 2E:
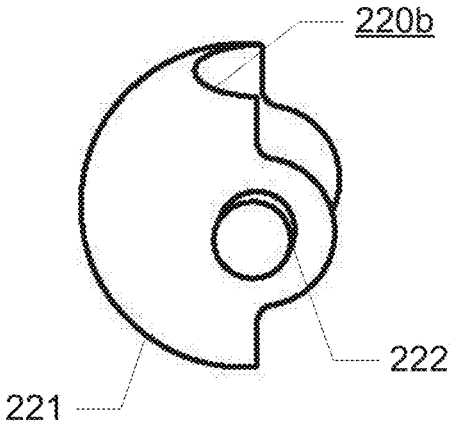
FIG. 2E illustrates a closure member of an annular isolation device for a riser, according to an alternative embodiment of the present invention.

Referring to FIGS. 2A and 2E, the closure member 220 may be disposed in the closure housing 215. The closure member 220 may be coupled to the closure housing 215 by a hinge 222. The hinge 222 may allow the closure member 220 to rotate about an axis angled relative to the bore 201*b* of the tubular body 201. The axis of rotation may be through the hinge 222. The axis of rotation may intersect a centerline of the bore 201*b*. The axis of rotation may be perpendicular to the centerline of the bore 201*b*. The closure member 220 may be a shell 221 with an outer face 221*f* (FIG. 2D). The shell 221 may be a hemisphere. The shell 221 may have a bore 220*b* through one face. The bore 220*b* may run perpendicular to the axis of rotation of the closure member 220. A radial side of the bore 220*b* may be open to the closure housing 215. The bore 220*b* may be the same size or greater than the bore 201*b* of the tubular body. The hinge 222 may be coupled to the shaft 231 by a linkage arm 223. The linkage arm 223 may have a groove 223*g* for receiving a tab 233 of the piston 230. As the shaft 231 moves axially through the outer housing 210 and closure housing 215, the tab 233 may move through the groove 223*g* of the linkage arm 223. The force of the tab 233 acting on the groove 223*g* may rotate the linkage arm 223 and closure member 220 about the hinge 222. The tubular body 201 may have a face 201*f* with a curved profile for engaging the outer face 221*f* of the shell 221. The face 201*f* may be an elastomer for sealing against the outer face 221*f*. Alternatively, the actuator may be a motor.

In operation, the actuator, such as piston 230 and shaft 231, rotates the shell 221 between an open position (FIG. 2A, 2B) and a closed position (FIG. 2C, 2D). In the open position, fluid communication is permitted through the bore 201*b* of the tubular body 201. In the open position, the centerline of the bore 201*b* of the tubular body may be in alignment with a centerline of the bore 220*b* of the closure member 220. In the closed position, the face 201*f* of the tubular body 201 engages the outer face 221*f* of the shell 221, isolating fluid communication in the bore 201*b*.

In order to isolate fluid communication in the bore 201*b*, fluid is pumped into the piston chamber 230*p* to move the piston 230 longitudinally toward seal 232. The shaft 231 moves longitudinally through the outer housing 210 and closure housing 215. The tab 233 begins to act on the groove 223*g*. The force applied by the tab 233 on the groove 223*g* causes the shell 221 to rotate about the axis through the hinge 222. The piston 230 continues moving through piston chamber 230*p* towards seal 232. The outer face 221*f* rotates into engagement with the curved profile of the face 201*f* of the tubular body, sealing the bore 201*b* of the tubular body 201. The closed position (FIG. 2C, 2D) of the closure member 220 isolates fluid communication in the tubular body 201.

In order to permit fluid communication in the bore 201*b*, fluid is pumped into the piston chamber 230*p* to move the piston longitudinally toward seal 234. The shaft 231 moves longitudinally through the outer housing 210 and closure housing 215. The tab 233 begins to act on the groove 223*g*. The forced applied by the tab 233 on the groove 223*g* causes the shell 221 to rotate about the axis through the hinge 222. The piston 230 continues moving through piston chamber 230*p* towards seal 234. The outer face 221*f* rotates out of engagement with the curved profile of the face 201*f* of the tubular body. The bore 220*b* of the closure member 220 rotates into alignment with the bore 201*b* of the tubular body 201, permitting fluid communication through the tubular body 201.

Alternatively, the embodiment of FIGS. 2A-D may include a sleeve member (not shown) to protect the shell 221 from damage by production fluid while the shell 221 is in the open position. The sleeve member may be axially movable in the bore 201*b* of the tubular body 201. The sleeve member may be actuated between an open position, where the sleeve member is disposed in the bore 201*b* of the tubular body 201, and a closed position, where the sleeve member extends axially into the closure housing 215. In the closed position, the sleeve member would prevent production fluid from damaging the shell 221 by sealing the bore 201*b* of the tubular body 201 from the closure housing 215 while the shell 221 is disposed in the closure housing 215.

Alternatively, a port may be disposed in a wall of the tubular body below the closure member. The port may be operated to relieve pressure buildup in the tubular body under the closure member. When the port is in an open position, the port may be in fluid communication with the bore of the tubular body below the closure member. The port may be connected by a fluid line to the MODU. Alternatively, the port may be disposed in a wall of the closure housing below the closure member.

Alternatively, a plurality of pressure transducers may be used to measure a pressure in the bore of the tubular body above and below the closure member. The pressure transducers may be located in a wall of the tubular body. The measured pressure in the bore of the tubular body may be used to determine when to relieve pressure in the tubular body under the closure member by using the port.

Figures 3A, 3B:
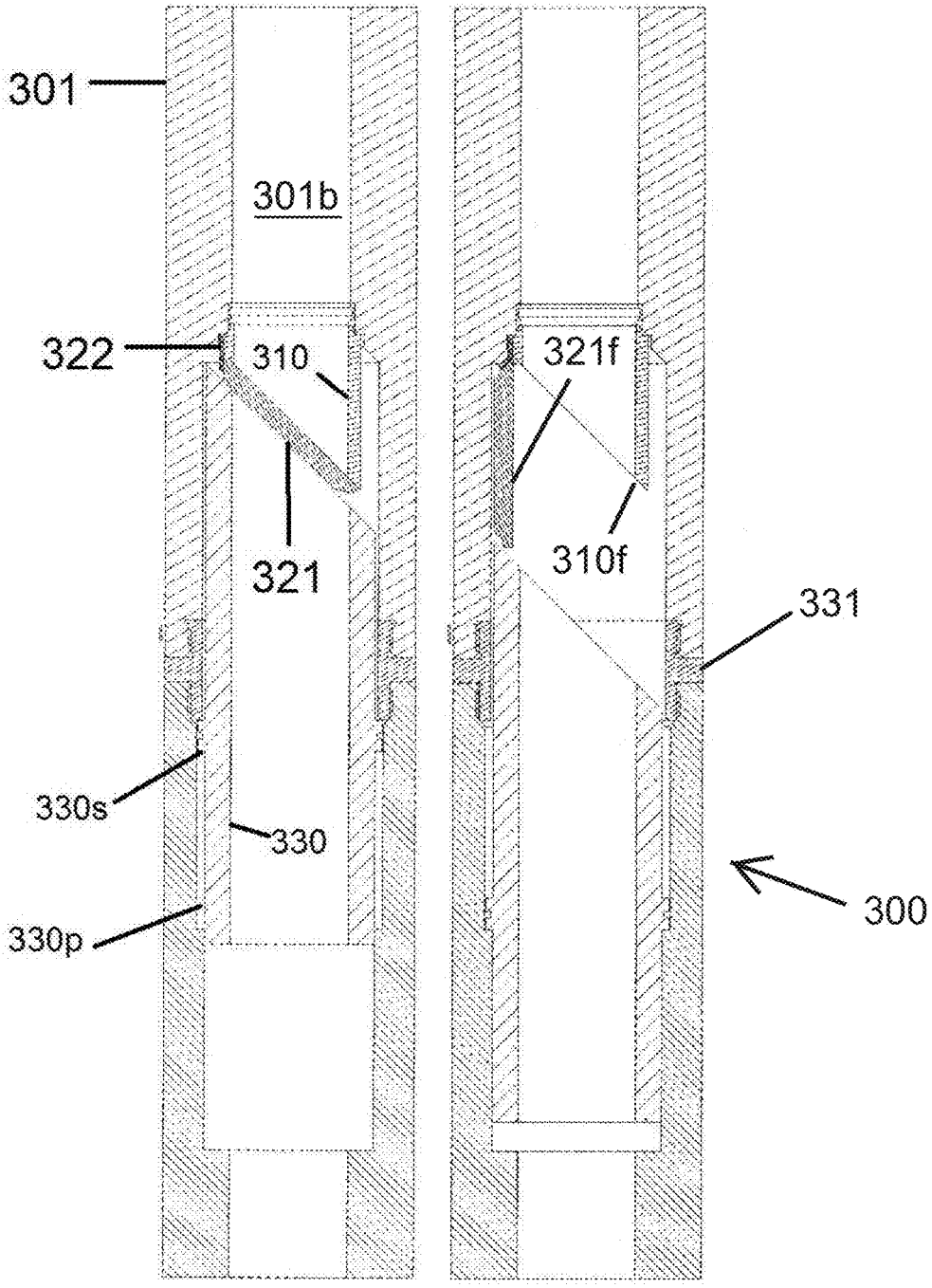
FIG. 3A-B illustrate an annular isolation device for a riser, according to an alternative embodiment of the present invention.

FIGS. 3A-B illustrate another embodiment of the present invention. The annular isolation device 300 may include a tubular body 301, a first sleeve member, a closure member, such as a flapper 321, and a second sleeve member.

The tubular body 301 may be a section of a tubular string. The tubular body 301 may have a longitudinal bore 301*b* therethrough. The tubular body 301 may have couplings, such as flanged couplings, at longitudinal ends for connecting to another section of the tubular string. The tubular body 301 may be a marine drilling riser. The tubular body 301 may have a sleeve recess formed along an inner surface. The tubular body 301 may also have a piston recess formed along the inner surface.

The first sleeve member may be a movable sleeve member 330. The second sleeve member may be a stationary sleeve member 310. The stationary sleeve member 310 may be coupled to the tubular body 301. The stationary sleeve member 310 may have a face 310*f*, angled with respect to a centerline of the bore 301*b* of the tubular body 301. The closure member may be a flapper 321 pivotally coupled to the tubular body 301 by a hinge 322. The flapper 321 may have a sealing face 321*f* for engaging the face 310*f*. The flapper 321 may be disposed in the sleeve recess of the tubular body 301 when in the open position, described below. The flapper 321 may be biased to the open position by the force of gravity. The sealing face 321*f* may be angled relative to the bore 301*b* of the tubular body 301 when the flapper 321 is in the closed position, described below.

The movable sleeve member 330 may be disposed in the sleeve recess of the tubular body 301. The movable sleeve member 330 may be axially movable in the sleeve recess of the tubular body 301. The movable sleeve member 330 may be axially movable relative to the stationary sleeve member 310. A shoulder 330*s* of the movable sleeve member 330 may form a piston chamber 330*p*, between the outer surface of the movable sleeve member 330 and the piston recess of the tubular body 301. The piston chamber 330*p* may be separated into a first chamber and a second chamber by the shoulder 330*s* of the sleeve member. The piston chamber 330*p* may have stops 331. The stops 331 may contact the shoulder 330*s* of the movable sleeve member 330 and prevent further axial movement of the movable sleeve member 330 in the tubular body 301. The movable sleeve member 330 may have a face 330*f* angled relative to a centerline of the bore 301*b* of the tubular body 301 for engaging a bottom surface of the flapper 321.

In operation, hydraulic fluid is supplied to the piston chamber 330*p*. The hydraulic fluid moves the shoulder 330*s* longitudinally through the piston chamber 330*p* towards the stops 331. The movable sleeve member 330 moves longitudinally through the sleeve recess of the tubular body 301 towards the flapper 321. The flapper 321 begins in an open position (FIG. 3B), permitting fluid flow through the bore 301*b* of the tubular body 301. The face 330*f* of the movable sleeve member 330 engages a bottom surface of the flapper 321. The movable sleeve member 330 lifts the flapper 321 into a closed position, isolating fluid flow through the bore 301*b* of the tubular body 301. The flapper 321 pivots around the hinge 322 until the sealing face 321*f* engages the face 310*f* of the stationary sleeve member 310 (FIG. 3A). The shoulder 330*s* may engage the stops 331, preventing further longitudinal movement of the movable sleeve member 330. In the closed position, the sealing face 321*f* of the flapper 321 is angled relative to a centerline of the bore 301*b* of the tubular body 301.

The process may be reversed to permit fluid communication through the bore 301*b* of the tubular body 301. Hydraulic fluid is supplied to the piston chamber 330*p* to move the shoulder 330*s* away from the stops 331. The movable sleeve member 330 moves longitudinally away from the stationary sleeve member 310. The flapper 321 is biased to the open position due to the force of gravity. The flapper 321 rotates about hinge 322 away from the stationary sleeve member 310, permitting fluid communication through the bore 301*b*.

Alternatively, a port may be disposed in a wall of the tubular body below the closure member. The port may be operated to relieve pressure buildup in the tubular body under the closure member. When the port is in an open position, the port may be in fluid communication with the bore of the tubular body below the closure member. The port may be connected by a fluid line to the MODU.

Alternatively, a plurality of pressure transducers may be used to measure a pressure in the bore of the tubular body above and below the closure member. The pressure transducers may be located in a wall of the tubular body. The measured pressure in the bore of the tubular body may be used to determine when to relieve pressure in the tubular body under the closure member by using the port.

Figures 4A, 4B:
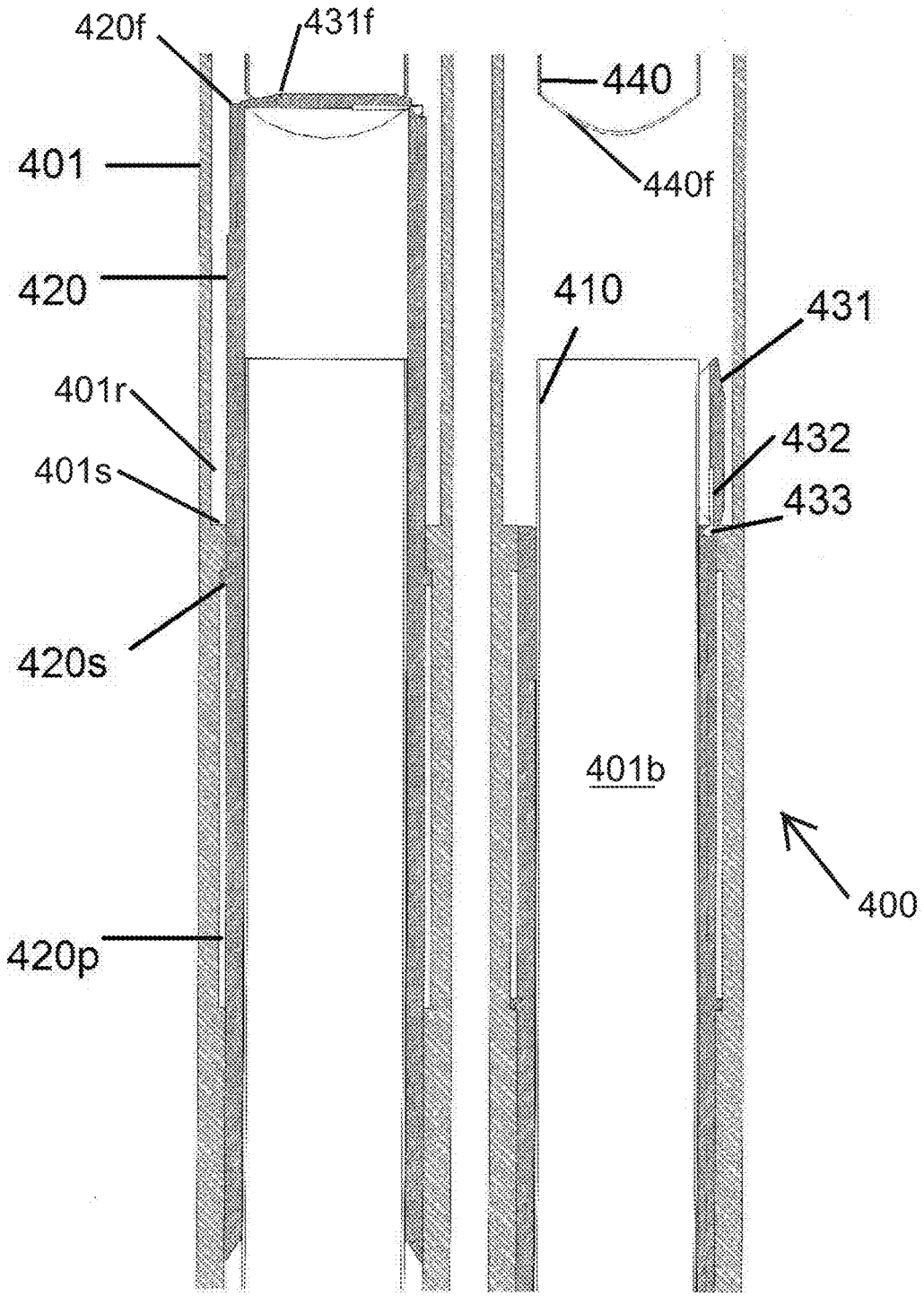
FIG. 4A-B illustrate an annular isolation device for a riser, according to an alternative embodiment of the present invention.

FIGS. 4A-B illustrate an alternative embodiment of the present invention. The annular isolation device 400 may include a tubular body 401, a first sleeve member, a second sleeve member, a closure member, such as a flapper 431, and a third sleeve member 440.

The tubular body 401 may have a bore 401*b* therethrough. The tubular body 401 may have couplings, such as flanged couplings, at longitudinal ends for coupling to another section of the tubular string. The tubular body 401 may be a marine drilling riser. An inner recess 401*r* may be formed along the inner surface of the tubular body 401. A piston recess may be formed along the inner surface of the tubular body 401. A stop 401*s* may be formed along the inner surface, separating the inner recess 401*r* from the piston recess.

The first sleeve member may be a movable sleeve member 420. The second sleeve member may be a stationary sleeve member 410. The stationary sleeve member 410 may be disposed in the tubular body 401. The stationary sleeve member 410 may have a bore therethrough. The stationary sleeve member 410 may be axially fixed relative to the tubular body 401. The inner recess 401*r* may be formed between the inner surface of the tubular body 401 and the outer surface of the stationary sleeve member 410.

The movable sleeve member 420 may be disposed in the tubular body 401. Stationary sleeve member 410 may be disposed in the movable sleeve member 420. The movable sleeve member 420 may have a bore therethrough. The movable sleeve member 420 may have a face 420*f*. The movable sleeve member 420 may be axially movable within the tubular body 401 between a first position (FIG. 4B) and a second position (FIG. 4A). The movable sleeve member 420 may be axially movable relative to the stationary sleeve member 410. The movable sleeve member 420 may have a shoulder 420*s* formed on an outer surface. A piston chamber 420*p* may be formed in the piston recess between the outer surface of the movable sleeve member 420 and the inner surface of the tubular body 401. The shoulder 420*s* of the movable sleeve member 420 may separate the piston chamber 420*p* into a first chamber and a second chamber.

The third sleeve member 440 may have a tubular shape with a bore therethrough. The third sleeve member 440 may be disposed in the tubular body 401. The third sleeve member 440 may have a seat 440*f*. The third sleeve member 440 may be axially fixed relative to the tubular body 401 and the stationary sleeve member 410.

The closure member may be a flapper 431. The flapper 431 may be coupled to the movable sleeve member 420 by a hinge 432. The hinge 431 may have a biasing member, such as torsion spring 433. Torsion spring 433 may bias the flapper 431 towards the face 420*f* of the movable sleeve member 420. As the movable sleeve member 420 moves axially through the tubular body 401, the flapper 431 may move out of the inner recess 401*r*. The flapper 431 may have a first face for engaging the face 420*f* of the movable sleeve member 420. The flapper 431 may be movable between a closed position (FIG. 4A) where the first face of the flapper 431 contacts the face 420*f* of the movable sleeve member 420 and an open position (FIG. 4B) where the flapper 431 is disposed in the inner recess 401*r* of the tubular body 401. In the closed position, the flapper 431 isolates fluid communication through the bore 401*b* of the tubular body 401. The torsion spring 433 may provide sufficient force to create a seal between the flapper 431 and the movable sleeve member 420. In the open position, fluid communication is permitted through the bore 401*b* of the tubular body 401. In the open position, the closure member, such as flapper 431, is disposed in the inner recess 401*r*. The stationary sleeve member 410 maintains the flapper 431 in the open position, against the biasing force of the torsion spring 433. The flapper 431 may have a second face 431*f* for engaging the seat 440*f* of the third sleeve member 440 in an engaged position (FIG. 4B). The flapper 431 may be movable to the engaged position by the movable sleeve member 420. In the engaged position, the movable sleeve member 420 may be in the second position. The movable sleeve member 420 may provide an additional sealing force between the first face of the flapper 431 and the face 420*f* and also between the second face 431*f* and the seat 440*f*.

In operation, hydraulic fluid is supplied to the piston chamber 420*p*. The hydraulic fluid moves the shoulder 420*s* towards the stop 401*s*. The movement of the shoulder 420*s* causes the movable sleeve member 420 and the flapper 431 to move axially through the tubular body towards the third sleeve member 440. As the flapper 431 moves out of the inner recess 401*r*, torsion spring 433 biases the second face of the flapper 431 into engagement with the face 420*f* of the movable sleeve member 420. The torsion spring 433 provides sufficient force to create a seal between the face 420*f* of the movable sleeve member and the flapper 431, isolating fluid communication through the bore 401*b* of the tubular body 401. The shoulder 420*s* may continue moving longitudinally towards the stop 401*s*. The piston chamber 420*p* may have a sufficient length to allow the flapper 431 to engage the third sleeve member 440. The movable sleeve member 420 continues moving longitudinally towards the third sleeve member 440 until the flapper 431 engages the third sleeve member 440, in an engaged position (FIG. 4A). The second face 431*f* of the flapper 431 engages the seat 440*f* of the third sleeve member 440 while the bottom face of the flapper 431 engages the face 420*f* of the movable sleeve member 420. The hydraulic pressure in the piston chamber 420*p* acting on the shoulder 420*s* provides an additional sealing force between the first face of the flapper 431 and the face 420*f* of the movable sleeve member 420 and between the second face 431*f* of the flapper 431 and the seat 440*f* of the third sleeve member 440.

The process for isolating fluid communication through the bore 401*b* of the tubular body 401 may be reversed to move the flapper 431 to the open position. Fluid pressure is supplied to the piston chamber 420*p* to move the shoulder 420*s* away from the stop 401*s*. As the movable sleeve member 420 moves axially away from the third sleeve member 440, the stationary sleeve member 410 contacts the second face of the flapper 431. The continued axial movement of the movable sleeve member 420 causes the stationary sleeve member 410 to lift the flapper 431 from the closed position to the open position, against the biasing force of the torsion spring 433. The flapper 431 continues moving into the inner recess 401*r*, permitting fluid communication through the bore 401*b* of the tubular body 401. An outer surface of the stationary sleeve member 410 maintains the flapper 431 in the open position when the flapper 431 is disposed in the inner recess 401*r*.

Alternatively, a port may be disposed in a wall of the tubular body below the closure member. The port may be operated to relieve pressure buildup in the tubular body under the closure member. When the port is in an open position, the port may be in fluid communication with the bore of the tubular body below the closure member. The port may be connected by a fluid line to the MODU.

Alternatively, a plurality of pressure transducers may be used to measure a pressure in the bore of the tubular body above and below the closure member. The pressure transducers may be located in a wall of the tubular body. The measured pressure in the bore of the tubular body may be used to determine when to relieve pressure in the tubular body under the closure member by using the port.

FIGS. 5A-D illustrate an alternative embodiment of the present invention. The annular isolation device 600 may include a tubular body 601, an outer housing 610, a closure housing 620, an actuator, and a closure member. The tubular body 601 may have a bore 601*b* (FIG. 5C) therethrough. The tubular body 601 may be a section of a tubular string. The tubular body 601 may have couplings 601*c* at longitudinal ends for connecting to another section of the tubular string. Couplings 601*c* may be flanged couplings. The tubular body 601 may be a marine drilling riser.

The outer housing 610 may be disposed on an outer surface of the tubular body 601. The outer housing 610 may be disposed outside of the tubular body 601. The outer housing 610 may have a cylindrical shape. The outer housing 610 may extend longitudinally along the tubular body 601. The closure housing 620 may be at least partially disposed in the tubular body 601. The closure housing 620 may be at least partially disposed outside of the tubular body 601. The closure housing 620 may have a diameter greater than the diameter of the tubular body 601. The outer housing 610 may be disposed on an outer surface of the closure housing 620.

The actuator may be at least partially disposed in the outer housing 610. The actuator may be at least partially disposed in the closure housing 620. The actuator may be disposed outside of the tubular body 601. The actuator may be longitudinally movable through the outer housing 610 and the closure housing 620. The actuator may be a piston 621 coupled to a geared shaft 622. The piston 621 may be a disc. A piston chamber 623 may be formed between seals 624, 625. The piston 621 may be movable in the piston chamber 623. Seals 624, 625 may prevent fluid from leaking out of the piston chamber 623. The piston 621 may separate the piston chamber 623 into a first chamber and a second chamber. The geared shaft 622 may extend through a bearing 626 at an opposite end of the outer housing 610 from the piston chamber 623. Alternatively, the actuator may be a motor.

Figure 5D:
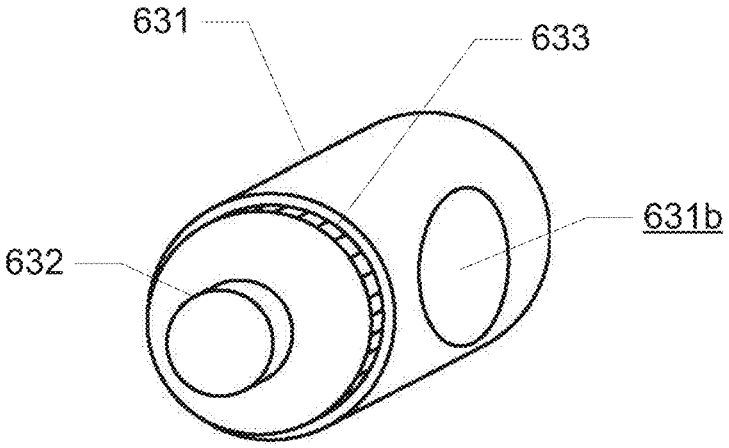
FIG. 5D illustrates a closure member of an annular isolation device for a riser, according to an alternative embodiment of the present invention.
Figure 5A:
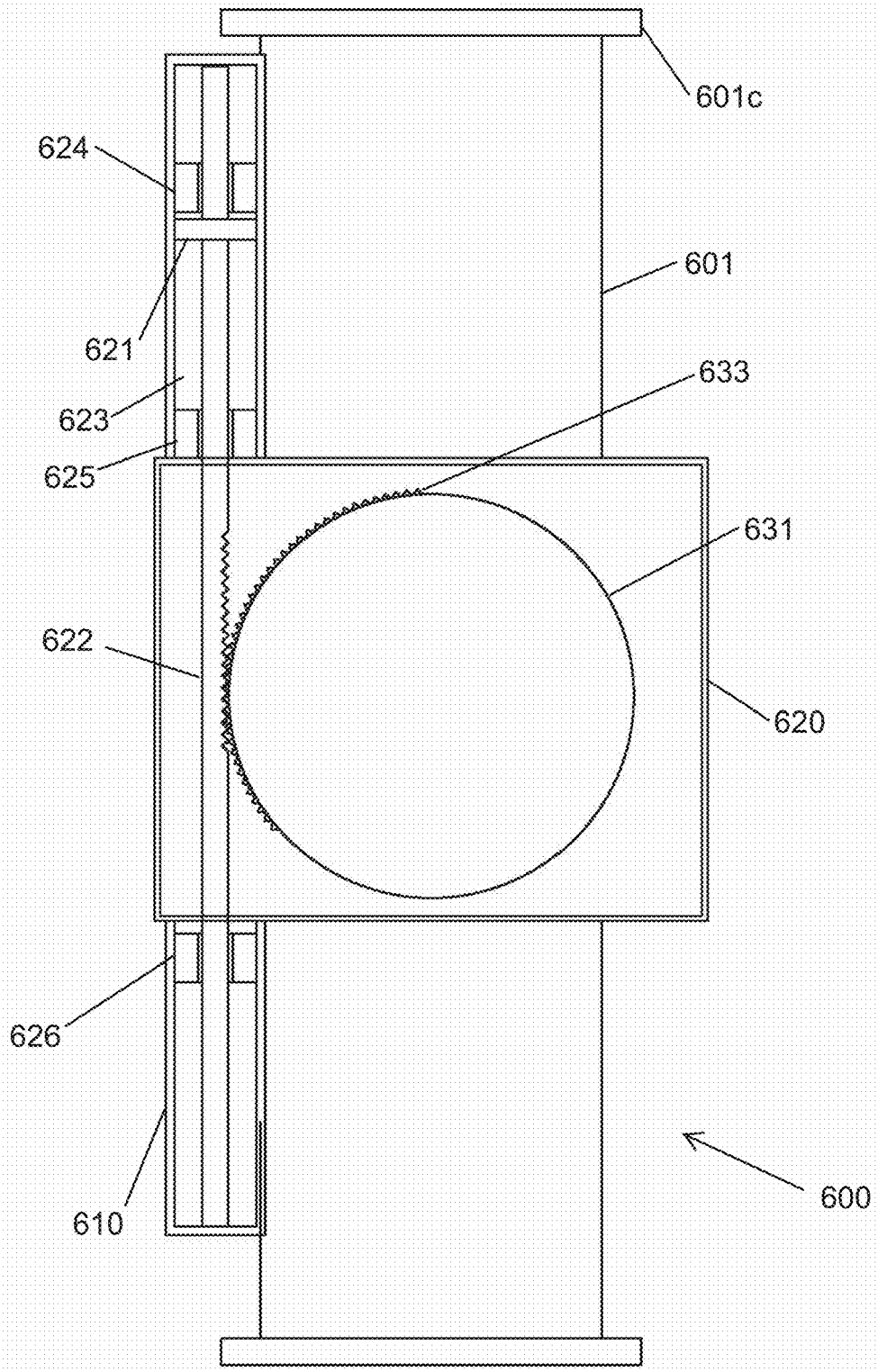
FIG. 5A illustrates an annular isolation device for a riser, according to an alternative embodiment of the present invention.
Figure 5C:
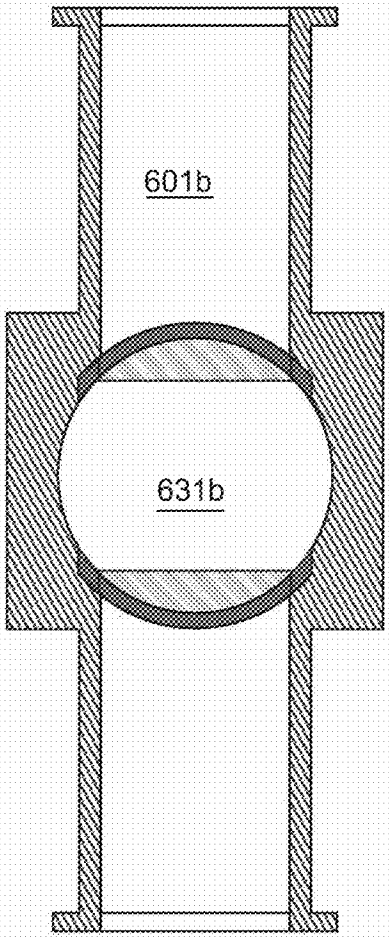
FIGS. 5B and 5C illustrate a longitudinal cross-section of an annular isolation device for a riser, according to an alternative embodiment of the present invention.
Figure 5B:
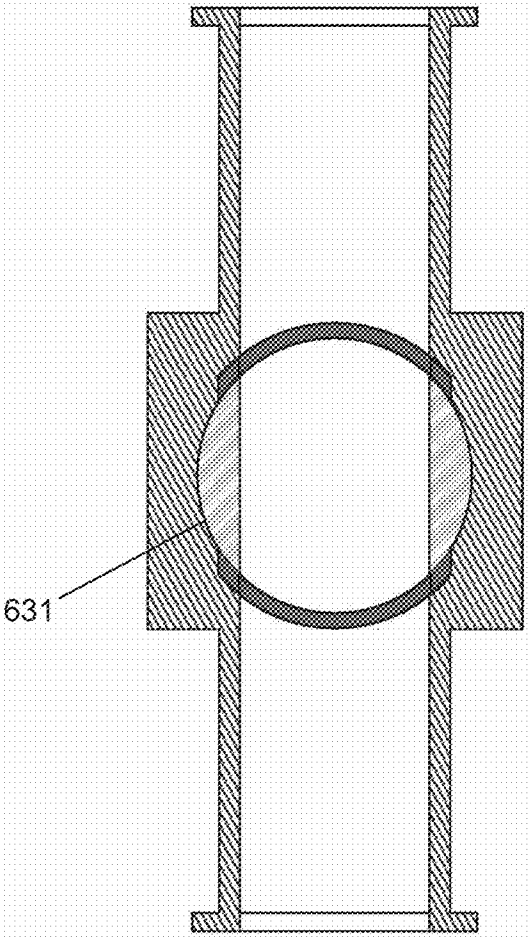

Referring to FIGS. 5A and 5D, the closure member may be disposed in the closure housing 620. The closure member may be a cylinder 631 with a bore 631*b* disposed radially therethrough. The cylinder 631 may have a hinge 632. The cylinder 631 may rotate about an axis through the hinge 632. The cylinder 631 may be coupled to the closure housing 620 by the hinge 632. The cylinder 631 may rotate about an axis angled relative to the bore 601*b* of the tubular body 601. The axis of rotation may be perpendicular to the bore 601*b*. The axis of rotation may intersect a centerline of the bore 601*b*. The axis of rotation may be perpendicular to the centerline of the bore 601*b*. The bore 631*b* may run perpendicular to the axis of rotation. The bore 631*b* may be the same or greater in size than the bore 601*b*. The axis of rotation may be through the hinge 632. The cylinder 631 may rotate between an open position (FIG. 5B) and a closed position (FIG. 5C). In the open position, the bore 631*b* is aligned with the bore 601*b* of the tubular body 601, permitting fluid communication through the tubular body 601. In the open position, a centerline of the bore 631*b* may be aligned with the centerline of the bore 601*b*. In the closed position, the bore 631*b* has been rotated completely out of alignment with the bore 601*b*, isolating fluid communication in the tubular body 601. The cylinder 631 may have geared teeth 633 on an outer surface configured to engage the geared shaft 622. Force applied by the geared shaft 622 to the geared teeth 633 may cause the cylinder 631 to rotate between the open position and the closed position. The tubular body 601 may have a curved face for engaging the outer surface of the cylinder 631 in the closed position.

In operation, hydraulic fluid is supplied to the piston chamber 623. The piston 621 moves longitudinally through the piston chamber 623 towards the seal 625. The geared shaft 622 engages the geared teeth 633 of the cylinder 631. The movement of the piston 621 results in a force being exerted between the geared shaft 622 and the geared teeth 633 of the cylinder 631. The geared shaft 622 begins to rotate the cylinder 631 from the open position (FIG. 5B) where the bore 631*b* of the cylinder 631 is longitudinally aligned with the bore 601*b* of the tubular body 601. The cylinder 631 is rotated to the closed position (FIG. 5C) where the curved face of the tubular body 601 engages the outer surface of the cylinder 631. The bore 631*b* of the cylinder 631 has been rotated completely out of alignment with the bore 601*b*, isolating fluid communication through the tubular body 601.

In order to permit fluid communication through the tubular body 601, the process may be reversed. Hydraulic fluid is supplied to the piston chamber 623. The piston 621 moves longitudinally through the piston chamber 623 towards the seal 624. The geared shaft 622 engages the geared teeth 633 of the cylinder 631. The movement of the piston results in a force being exerted between the geared shaft 622 and the geared teeth of the cylinder 631. The geared shaft 622 begins to rotate the cylinder 631 in an opposite direction from the closed position to the open position. The bore 631*b* of the cylinder 631 is rotated into alignment with the bore 601*b* of the tubular body 601, permitting fluid communication through the tubular body. The cylinder 631 may be rotated to a position where the centerline of the bore 631*b* is in alignment with the centerline of bore 601*b*.

Alternatively, a port may be disposed in a wall of the tubular body below the closure member. The port may be operated to relieve pressure buildup in the tubular body under the closure member. When in the port is in an open position, the port may be in fluid communication with the bore of the tubular body below the closure member. The port may be connected by a fluid line to the MODU. Alternatively, the port may be disposed in a wall of the closure housing below the closure member.

Alternatively, a plurality of pressure transducers may be used to measure a pressure in the bore of the tubular body above and below the closure member. The pressure transducers may be located in a wall of the tubular body. The measured pressure in the bore of the tubular body may be used to determine when to relieve pressure in the tubular body under the closure member by using the port.

While the foregoing is directed to embodiments of the present disclosure, other and further embodiments of the disclosure may be devised without departing from the basic scope thereof, and the scope of the invention is determined by the claims that follow.

The invention claimed is:

1. An annular isolation device for a riser, comprising:
a tubular body connectable to the riser;
a closure member rotatable between an open position permitting fluid communication through the tubular body and a closed position isolating fluid communication, wherein the closure member is at least partially disposed outside the tubular body when in the open position;
a first sleeve member disposed in the tubular body, the first sleeve member configured to axially move the closure member while the closure member is in the closed position; and
an actuator operable to rotate the closure member between the open position and the closed position.

2. The annular isolation device of claim 1, further comprising a closure housing, wherein the closure member is disposed in the closure housing when the closure member is in the open position and wherein the closure housing is at least partially disposed outside the tubular body.

3. The annular isolation device of claim 2, wherein the first sleeve member is axially movable between a first position, wherein the first sleeve member isolates the tubular body from the closure housing and a second position, wherein the closure housing is open to the tubular body.

4. The annular isolation device of claim 1, wherein the first sleeve member is configured to axially move the closure member into an engaged position and wherein a second sleeve member is configured to contact the closure member in the engaged position.

5. The annular isolation device of claim 4, wherein the first sleeve member is axially movable to contact the closure member.

6. The annular isolation device of claim 1, wherein the closure member is movable between the open position, the closed position, and an engaged position.

7. An annular isolation device for a riser, comprising:
a tubular body connectable to the riser;
a closure member rotatable between an open position permitting fluid communication through the tubular body and a closed position isolating fluid communication; and
an actuator operable to rotate the closure member between the open position and the closed position
wherein the actuator comprises a piston disposed on a shaft, the shaft comprising a spline and the closure member comprising:
a disc;
a hinge for rotating the closure member; and
a keyway for receiving the spline.

8. The annular isolation device of claim 7, wherein the spline is disposed in the keyway and operable to move the closure member between the closed position and the open position.

9. The annular isolation device of claim 7, the spline further comprising a straight portion and a curved portion.

10. A method for controlling fluid flow in a riser, comprising:
positioning a closure member in an open positon permitting fluid communication through a tubular body;
rotating the closure member to a closed position isolating fluid communication through the tubular body;
moving a first sleeve member disposed in the tubular body into engagement with the closure member; and
moving the closure member axially while maintaining the closure member in the closed position.

11. The method of claim 10, wherein the actuator comprises a piston disposed on a shaft.

12. The method of claim 10, further comprising disposing the closure member in a closure housing when the closure member is in the open position, wherein the closure housing is at least partially disposed outside the tubular body.

13. The method of claim 10, further comprising:
moving the first sleeve member; and
engaging the closure member with the first sleeve member when the closure member is in the closed position.

14. The method of claim 10, further comprising engaging the closure member with the first sleeve member and a second sleeve member.

15. The method of claim 10, wherein the closure member is disposed in the tubular body.

16. The method of claim 10, wherein the closure member includes a keyway for receiving a spline.

17. The method of claim 10, wherein the closure member is movable between the open position, the closed position, and an engaged position.

18. The method of claim 10, wherein the closure member is a disc.

19. The method of claim 12, further comprising moving the first sleeve member between a first position, wherein the first sleeve member isolates the tubular body from the closure housing and a second position, wherein the closure housing is open to the tubular body.

20. The method of claim 10, wherein the closure member is at least partially disposed outside of the tubular body when in the open position.

21. An annular isolation device for a riser, comprising:
a tubular body connectable to the riser and having a bore;
a closure member rotatable between an open position permitting fluid communication through the tubular body and a closed positon isolating fluid communication ;
a first sleeve member disposed in the tubular body, the first sleeve member configured to provide the closure member access to the bore and configured to contact and axially move the closure member while the closure member is in the closed position; and
an actuator operable to rotate the closure member to the open position when the closure member is not in contact with the first sleeve member.

22. The annular isolation device of claim 20, wherein the first sleeve member isolates the closure member from the bore when in a first positon, and wherein the first sleeve member provides the closure member access to rotate into the bore when in a second positon.

* * * * *